US007695569B2

(12) United States Patent
Nakagawa et al.

(10) Patent No.: US 7,695,569 B2
(45) Date of Patent: Apr. 13, 2010

(54) DETERGENT FOR HARD SURFACES

(75) Inventors: Yosuke Nakagawa, Wakayama (JP); Noriyuki Morii, Wakayama (JP); Kazunori Tsukuda, Tokyo (JP); Kenichi Shiba, Wakayama (JP); Hirofumi Mizukoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 11/661,380

(22) PCT Filed: Nov. 16, 2005

(86) PCT No.: PCT/JP2005/021390

§ 371 (c)(1),
(2), (4) Date: Mar. 11, 2008

(87) PCT Pub. No.: WO2006/054752

PCT Pub. Date: May 26, 2006

(65) Prior Publication Data

US 2008/0261856 A1 Oct. 23, 2008

(30) Foreign Application Priority Data

Nov. 18, 2004 (JP) ..... 2004-334407

(51) Int. Cl.
*B08B 3/04* (2006.01)
*C11D 3/37* (2006.01)
*C11D 1/00* (2006.01)

(52) U.S. Cl. ..... 134/25.2; 134/25.3; 134/39; 134/42; 510/197; 510/199; 510/238; 510/475; 510/499; 510/504

(58) Field of Classification Search ..... 510/197, 510/199, 238, 475, 499, 504; 134/25.2, 25.3, 134/39, 42
See application file for complete search history.

(56) References Cited

U.S. PATENT DOCUMENTS 5,662,997 A * 9/1997 Onishi et al. ..... 428/331

FOREIGN PATENT DOCUMENTS

| | | | |
|---|---|---|---|
| EP | 0560519 | A | 9/1993 |
| JP | 56099204 | A | 8/1981 |
| JP | 56-131699 | A | 10/1981 |
| JP | 6-228871 | A | 8/1994 |
| JP | 8-60137 | A | 3/1996 |
| JP | 8-253796 | A | 10/1996 |
| JP | 8-253797 | A | 10/1996 |
| JP | 2000-284240 | A | 10/2000 |
| JP | 2002-60793 | A | 2/2002 |
| JP | 2002-265996 | A | 9/2002 |
| JP | 2003-183694 | A | 7/2003 |

* cited by examiner

*Primary Examiner*—Brian P Mruk
(74) *Attorney, Agent, or Firm*—Birch, Stewart, Kolasch & Birch, LLP

(57) ABSTRACT

The invention relates to a detergent for hard surfaces, which contains (a) a polymer compound having a cationic group, such as a cation-modified polyvinyl alcohol containing specified structural units, (b) a surfactant and (c) water.

11 Claims, No Drawings

DETERGENT FOR HARD SURFACES

FIELD OF THE INVENTION

The present invention relates to a detergent for various hard surfaces of plastic products, metal products etc. in facilities used around water for example in homes.

PRIOR ARTS TO THE INVENTION

In a bathroom, a bathtub, a sink etc. as facilities in homes, water droplets easily adhere to, and remain on, the surfaces of materials of facilities after use, due to scattering of water from a tap or a shower during use. In the case of a bathroom, these remaining water droplets lead easily to generation of mold etc. with humidity, and in the case of a sink, the remaining water droplets, while maintaining the shape thereof at the time of adhering to the surface, are gradually evaporated to easily leave small ring-shaped traces. General measures taken by the consumer against such inconvenient states are that in the case of a sink, efforts toward keeping it beautiful are made by wiping water away with a cloth or the like, or in the case of a bathroom or a bathtub, efforts toward accelerating drying are made by opening a window and door or by working a ventilation fan to eliminate humidity from the bathroom, but any of these measures are not satisfactory because of a problem in security, a problem of incoming pollutants from outdoor, or from the viewpoint of saving energy.

Under these circumstances, there has been demand for treatment methods and treating agents for rapid drying carried out easily by the consumer without leaving water droplets in facilities around water, such as a bathroom, a bathtub and a sink. With respect to techniques previously disclosed for treatment of hard surfaces, JP-A 2002-265996 discloses a cleaning antifouling treating agent for hydrophobic hard surfaces such as a coated surface of an automobile, containing a specific surfactant and a soil release polymer, JP-A 8-253796 and JP-A 8-253797 disclose respectively a detergent composition for hard surfaces, containing a surfactant and a specific water-soluble polymer, and JP-A 2003-183694 discloses an agent for conferring quick-drying properties, containing a specific cationic copolymerization polymer.

SUMMARY OF THE INVENTION

The present invention relates to a detergent for hard surfaces, which contains (a) a polymer compound containing structural units (a1), (a2) and (a3) represented by the following general formulae (1), (2) and (3), respectively, [referred to hereinafter as component (a)], (b) a surfactant [referred to hereinafter as component (b)], and (c) water:

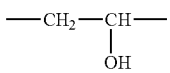

(1)

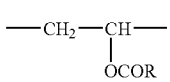

(2)

(3)

wherein R is a C1 to C3 alkyl group, and X is a structural unit derived from an unsaturated compound having a cation group in the molecule thereof and copolymerizable with a vinyl alcohol lower fatty ester.

The present invention relates to a method of treating hard surface by applying the above-described detergent onto the hard surfaces. It relates to use of the above-described detergent as a detergent for hard surfaces.

DETAILED DESCRIPTION OF THE INVENTION

Accordingly, the present invention provides a treating agent which is excellent in liquid stability and capable of giving a drying-accelerating effect on hard surfaces around water, such as those of a bathroom, a bathtub, a sink etc.

However, JP-A 2002-265996, JP-A 8-253796, JP-A 8-253797 and JP-A 2003-183694 supra do not show a drying-accelerating effect on surface materials of a bathroom, a bathtub, a sink etc. Under these circumstances, there is need for a treating agent for easy and quick drying without allowing water droplets to remain on the hard surfaces of facilities around water, such as a bathroom, a bathtub and a sink. Such treating agent is desirably superior in compatibility with blending components and excellent in liquid stability.

According to the present invention, there is obtained a detergent for hard surfaces which is applied onto hard surfaces around water followed by washing, thereby allowing water droplets to be prevented from remaining thereon and enabling acceleration of drying, and which is excellent in liquid stability.

<Component (a)>

The polymer compound as the component (a) having the structural units (a1), (a2) and (a3), respectively, can be obtained by copolymerizing a monomer compound from which the structural unit (a2) is derived, with a monomer compound from which the structural unit (a3) is derived, followed by partially saponifying the resulting copolymer. For example, a cationized polyvinyl alcohol obtained by partially saponifying a copolymer including a polymerizable cationic monomer (compound from which the structural unit (a3) is derived) and vinyl acetate can be used as the polymer compound as the component (a) wherein R in the general formula (2) is a methyl group.

The monomer compound from which the structural unit (a3) is derived is a compound having one or more cationic groups in its molecule and copolymerizable with a vinyl alcohol lower (C1 to C3) fatty ester (compound from which the structural units (a1) and (a2) are derived), and includes a compound selected from the compounds represented by the following general formulae (3-1) and (3-2):

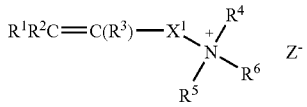

(3-1)

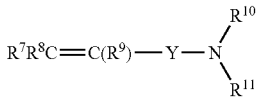

(3-2)

wherein $R^1$, $R^2$, $R^3$, $R^7$, $R^8$, and $R^9$ independently represent a hydrogen atom or a C1 to C3 alkyl group; $X^1$ and Y independently represent a group selected from a C1 to C12 alkylene group, —$COOR^{12}$—, —$CONHR^{12}$—, —$OCOR^{12}$— and —$R^{13}$—OCO—$R^{12}$— wherein $R^{12}$ and $R^{13}$ independently represent a C1 to C5 alkylene group; $R^4$ represents a C1 to C3 alkyl group, a hydroxyalkyl group or $R^1R^2C{=}C(R^3)$—$X^1$—; $R^5$ represents a C1 to C3 alkyl group or a hydroxyalkyl group; $R^6$ represents a C1 to C3 alkyl group, a hydroxyalkyl group, or a benzyl group; Z— represents an anion; $R^{10}$ represents a hydrogen atom, a C1 to C3 alkyl group, a hydroxyalkyl group or $R^7R^8C{=}C(R^9)$—Y—; and $R^{11}$ represents a hydrogen atom, a C1 to C3 alkyl group or a hydroxyalkyl group.

The specific monomer compound from which the structural unit (a3) is derived includes a compound selected from a diallyldialkyl (number of carbon atoms in the alkyl group: 1 to 3) ammonium salt, an N-(meth)acryloylaminoalkyl (number of carbon atoms in the alkyl group: 1 to 5)-N,N-dialkyl (number of carbon atoms in the alkyl group: 1 to 3) ammonium salt, an N-(meth)acryloylaminoalkyl (number of carbon atoms in the alkyl group: 1 to 5)-N,N,N-trialkyl (number of carbon atoms in the alkyl group: 1 to 3) ammonium salt, an N-(meth)acryloyloxyalkyl (number of carbon atoms in the alkyl group: 1 to 5)-N,N,N-trialkyl (number of carbon atoms in the alkyl group: 1 to 3) ammonium salt, and an N-(ω-alkenyl (number of carbon atoms in the alkenyl group: 2 to 10))-N,N-dialkyl (number of carbon atoms in the alkyl group: 1 to 3) ammonium salt.

The total of the structural units (a1), (a2) and (a3) as the structural units in the component (a) is preferably 50 to 100 mol %, more preferably 80 to 100 mol %, from the viewpoint of the effect.

The total of the cation group-containing structural unit (a3) out of the structural units in (a) is preferably 0.001 to 10 mol %, more preferably 0.001 to 5 mol %, from the viewpoint of the effect.

The molar ratio of the structural unit (a1) to the structural unit (a2) [(a1)/(a2)] in the component (a) is in the range of preferably 300 to 1, more preferably 50 to 2, still more preferably 20 to 2.5, from the viewpoint of solubility and performance. The weight-average molecular weight of the component (a) is preferably 10,000 to 1,000,000, more preferably 10,000 to 500,000, still more preferably 10,000 to 200,000. As used herein, the weight-average molecular weight can be determined by gel permeation chromatography using polyethylene glycol as the standard.

<Component (b)>

The surfactant as the component (b) includes at least one kind of surfactant selected from an anionic surfactant, a nonionic surfactant, a cationic surfactant and an amphoteric surfactant.

The anionic surfactant includes a higher fatty acid salt, a higher alcohol sulfate or its salt, a higher alcohol sulfonate, a sulfated fatty acid salt, a higher alcohol ether sulfonate, a higher alcohol ether-substituted acetate, sulfosuccinate, an alkyl benzene sulfonate, an alkyl phenol sulfonate, an alkyl naphthalene sulfonate, an amide ether carboxylic acid or its salt, an ether carboxylic acid or its salt, N-acyl-N-methyl taurine or its salt, amide ether sulfate or its salt, N-acyl-glutamic acid or its salt, N-amide ethyl-N-hydroxyethyl acetic acid or its salt, N-acyl-β-alanine or its salt, N-acyl-N-carboxyethyl taurine or its salt, and N-acyl-N-carboxyethyl glycine or its salt. Mention can also be made of an anionic surfactant selected from an alkyl (or alkenyl) benzene sulfonate having a C10 to C18 alkyl or alkenyl group, a polyoxyalkylene alkyl (or alkenyl) ether sulfate having a C10 to C18 alkyl or alkenyl group, an alkyl (or alkenyl) sulfate having a C10 to C18 alkyl or alkenyl group, an α-olefin (C10 to C18) sulfonate, an α-sulfofatty acid salt (C10 to C18), an α-sulfofatty acid (C10 to C18) lower alkyl (C1 to C2) ester salt, a secondary alkane sulfonate (C13 to C18), a polyoxyethylene alkyl ether carboxylate (C10 to C18), a polyoxyethylene amide alkyl ether carboxylate (C8 to C18) etc.

The nonionic surfactant includes a polyoxyethylene alkyl ether, a polyoxyethylene alkylene ether, a polyoxyethylene sorbitan fatty ester, an alkyl polyglucoside, a sucrose fatty ester, an alkyl polyglycerin ether etc.

The cationic surfactant includes alkyl (C10 to C20) trimethyl ammonium salts such as lauryl trimethyl ammonium chloride, stearyl trimethyl ammonium chloride, cetyl trimethyl ammonium chloride etc.; dialkyl dimethyl ammonium salts such as distearyl dimethyl ammonium chloride, a dialkyl (C12 to C18) dimethyl ammonium chloride etc.; alkyl (C8 to C16) dimethyl benzyl ammonium salts such as an alkyl (C12 to C18) dimethyl benzyl ammonium chloride etc.; substituted benzalkonium salts; and benzethonium salts.

The amphoteric surfactant includes amine oxides such as an alkyl dimethyl amine oxide etc., and betaines such as an alkyl-N,N-dimethyl acetic betaine, a fatty amide propyl-N,N-dimethyl acetic betaine, an alkyl carboxymethyl hydroxyethyl imidazolium betaine, an alkyl hydroxy sulfobetaine etc.

These surfactants are used preferably as a mixture of two or more thereof.

<Detergent for Hard Surfaces>

The detergent for hard surfaces according to the present invention is a liquid, and contains the component (a) in an amount of preferably 0.001 to 5% by weight, more preferably 0.01 to 5% by weight, still more preferably 0.01 to 3% by weight. The detergent for hard surfaces contains the component (b) in an amount of preferably 0.001 to 20% by weight, more preferably 0.01 to 15% by weight, still more preferably 0.01 to 10% by weight. The balance is water.

The ratio by weight of the component (a) to the component (b) [(a)/(b)] is preferably in the range of 0.01/20 to 5/0.01, more preferably 0.1/15 to 5/0.1, still more preferably 0.1/10 to 3/0.1.

The detergent for hard surfaces according to the present invention can be blended with a water-soluble solvent such as a C1 to C5 monovalent alcohol, a C2 to C8 particularly C4 to C8 polyvalent alcohol, or a glycol ether having a C1 to C8 alkyl group, in an amount of 0.001 to 20% by weight, more preferably 0.001 to 10% by weight, based on the detergent. The water-soluble solvent includes a water-soluble solvent selected from ethanol, isopropyl alcohol, ethylene glycol, propylene glycol, diethylene glycol, dipropylene glycol, glycerin, isoprene glycol, a diethylene glycol monoalkyl (C4 to C8) ether, propylene glycol monomethyl ether, propylene glycol monoethyl ether, propylene glycol monopropyl ether, propylene glycol monobutyl ether, a dipropylene glycol alkyl (C1 to C4) ether, and a monoalkyl glyceryl ether having a C3 to C8 alkyl group whose alkyl residue contains 3 to 8 carbon atoms.

The detergent for hard surfaces according to the present invention can be blended with a chelating agent in an amount of preferably 0.001 to 15% by weight, more preferably 0.01 to 10% by weight, based on the detergent. The chelating agent includes tripolyphosphoric acid, pyrophosphoric acid, orthophosphoric acid, hexamethaphosphoric acid, and alkali metal salts thereof; ethylenediaminetetraacetic acid, hydroxyiminodiacetic acid, dihydroxyethyl glycine, nitrilotriacetic acid, hydroxyethylenediaminetriacetic acid, diethylenetriaminepentaacetic acid, triethylenetetraminehexaacetic acid, and alkali metal salts or alkaline earth metal salts thereof; aminotrimethylenephosphonic acid, 1-hydroxyethylidene-1,1-diphosphonic acid, ethylenediaminetetramethylenephosphonic acid, diethylenetriaminepentamethylenephosphonic acid, aminotrimethylenephosphonic acid, and alkali metal salts or alkaline earth metal salts thereof; a homopolymer or copolymer of a monomer selected from acrylic acid and methacrylic acid, an acrylic acid/maleic acid copolymer, poly-α-hydroxy acrylic acid and alkali metal salts thereof; at least one kind of polyvalent carboxylic acid selected from citric acid, succinic acid, malic acid, fumaric acid, tartaric acid, malonic acid and maleic acid, and at least one selected from alkali metal salts thereof; and an alkylglycine-N,N-diacetic acid, aspartic acid-N,N-diacetic acid, serine-N,N-diacetic acid, glutamic acid diacetic acid, ethylenediaminedisuccinic acid or salts thereof.

The detergent for hard surfaces according to the present invention can be blended with a hydrotrope in an amount of preferably 0.001 to 15% by weight, more preferably 0.01 to 10% by weight, based on the detergent. The hydrotrope includes benzene sulfonic acid substituted with one to three C1 to C3 alkyl groups, or salts thereof. More preferable examples include p-toluenesulfonic acid, m-xylenesulfonic acid, p-cumenesulfonic acid, ethylbenzenesulfonic acid etc., and when its salt is used, a sodium salt, a potassium salt or a magnesium salt is excellent.

In addition to the components described above, a perfume, an antibacterial agent, a viscosity regulator, a pigment, a dye and a suspending agent, for example, can be added to the detergent for hard surfaces according to the present invention in such a range that the effect of the present invention is not deteriorated. However, polyvinyl alcohol or denatured polyvinyl alcohol other than the component (a) may deteriorate the effect of the present invention, and thus the ratio of the amount [B] (% by weight) of polyvinyl alcohol or denatured polyvinyl alcohol other than the component (a) to the amount [A] (% by weight) of the component (a), that is, [B]/[A] is 0.4 or less, preferably 0.25 or less, still more preferably 0.1 or less.

The composition of the detergent for hard surfaces according to the present invention is regulated depending on treatment of hard surfaces. Each concentrated solution may be prepared and diluted just before use.

The pH of the detergent for hard surfaces of the invention at 20° C. is preferably 2 to 11, more preferably 3 to 10, still more preferably 4 to 8, from the viewpoint of safety in operation and damage to a base material. As the pH regulator, use can be made of an acid, for example an inorganic acid such as hydrochloric acid and sulfuric acid, an organic acid such as citric acid, succinic acid, malic acid, fumaric acid, tartaric acid, malonic acid and maleic acid or an alkali, for example sodium hydroxide, potassium hydroxide, ammonia or derivatives thereof, an amine salt such as monoethanol amine, diethanol amine and triethanol amine, sodium carbonate and potassium carbonate, or a combination thereof. These acids and alkalis may be combined for use as buffering agents.

The method of applying the detergent of the present invention onto a hard surface can be selected depending on the area etc. of the hard surface. For example, an aqueous solution containing 0.5 wt % component (a) can be sprayed in an amount of about 0.1 to 10 mL per 10 $cm^2$ and spread thinly with a sponge or the like.

The detergent of the present invention has a washing effect on oil stains, protein stains, sebum stains etc., and can confer hydrophilicity on hydrophobic hard surfaces, and the effect is excellent in durability. Accordingly, the present invention provides a method of treating hard surfaces, wherein durable suitable hydrophilicity is conferred by applying the detergent for hard surfaces according to the present invention onto hard surfaces. The detergent of the present invention not only hydrophilizes a hard surface but also accelerates drying. It is considered that the detergent of the present invention suitably hydrophilizes a hard surface thereby covering the surface with a water coating to generate a phenomenon of accelerating drying without leaving water droplets or a phenomenon of draining water off with water droplets hardly remaining (for example a phenomenon wherein the surface is covered once with a water coating and then the water is slowly drained off from the upper end), resulting in accelerating the drying of the hard surface. Since the hard surface endowed with these effects molds scarcely, the detergent of the present invention is also preferable for antimolding treatment. Further, the detergent of the present invention is also preferable for antifouling treatment because it is excellent in hydrophilicity so that stains particularly hydrophobic stains adhering to hard surfaces can be easily washed away.

The detergent of the present invention is applied preferably to hard surfaces constituting facilities around water, for example a hydrophobic hard surface made of a material selected from plastics, ceramics and metal, and specifically the detergent is applied preferably to reinforced plastics (FRP), vinyl chloride, polypropylene, polyethylene, ABS, nylon, stainless steel and tiles.

EXAMPLES

The present invention is described by reference to the Examples below. The Examples are provided for more illustrative purposes of the present invention and not intended to limit the present invention.

The detergents for hard surfaces shown in Table 1 were prepared and evaluated as follows. The results are shown in Table 1. The pH of each detergent was regulated with sodium hydroxide and hydrochloric acid.

(1) Compatibility

The state of the detergent just after preparation was observed with the naked eyes to evaluate compatibility under the following criteria:

○: Dissolved clearly without forming precipitates.

x: Precipitated or turbid.

(2) Water Draining

After 5 adults bathed in a bathtub made of FRP (60 cm×100 cm×55 cm), the bathtub was left overnight (9 hours), then drained, air-dried and subjected to evaluation. A detergent in Table 1 was charged into a commercial sprayer and then sprayed in an amount of 10 mL onto the bathtub, and the bathtub was rubbed lightly and rinsed with water to judge whether the phenomenon of water draining occurred or not. Separately, 2 mL of the detergent was sprayed onto a plate made of PVC (30 cm×30 cm) which was then rubbed lightly with a sponge and rinsed with water to judge with the naked eyes whether the phenomenon of water draining occurred or not. In this judgment, water draining was evaluated under the following criteria:

○: The water draining phenomenon occurred.

x: The water draining phenomenon did not occur.

TABLE 1

| | | | Example | | | | | Comparative example | |
|---|---|---|---|---|---|---|---|---|---|
| | | | 1 | 2 | 3 | 4 | 5 | 1 | 2 |
| Detergent composition | Composition (wt %) | (a) Cation-modified PVA | 0.5 | 0.5 | 0.5 | 0.5 | 0.5 | | |
| | | Anion-modified PVA | | | | | | 0.5 | |
| | | Unmodified PVA | | | | | | | 0.5 |
| | | (b) Sodium alkyl benzene sulfonate | | 2 | | 1 | | | |
| | | Sodium alkyl ether sulfate | 2 | | 2 | 1 | 2 | 2 | 2 |
| | | Polyoxyethylene alkyl ether | 2 | 2 | 2 | 1 | 2 | 2 | 2 |
| | | Alkyl glycoside | | | | 1 | | | |
| | | Alkyl amide propyl betaine | | 2 | 2 | 2 | 2 | | |
| | | Alkyl dimethyl benzyl ammonium chloride | | | | | 2 | | |
| | | Diethylene glycol monobutyl ether | 10 | 10 | 10 | 10 | 10 | 10 | 10 |
| | | Chelating agent | 5 | 5 | 5 | 5 | 5 | 5 | 5 |
| | | (c) Ion exchange water | balance | balance | balance | balance | balance | balance | balance |
| | Total | | 100 | 100 | 100 | 100 | 100 | 100 | 100 |
| | pH (20° C.) | | 7.5 | 7.5 | 7.5 | 7.5 | 7.5 | 7.5 | 7.5 |
| Compatibility | | | ○ | ○ | ○ | ○ | ○ | ○ | X |
| Water draining | | Bathtub made of FRP | ○ | ○ | ○ | ○ | ○ | X | X |
| | | Plate made of PVC | ○ | ○ | ○ | ○ | ○ | X | X |

(Note)
The components in the table are as follows:
Cation-modified PVA: Gohsefiemer K-210 manufactured by The Nippon Synthetic Chemical Industry Co., Ltd.; in the total structural units, the total of the structural units (a1), (a2) and (a3) is 100 mol %, the total of the structural unit (a3) is 0.9 mol %, and the molar ratio of the structural unit (a1) to the structural unit (a2) [(a1)/(a2)] is in the range of 85.5/14.5 to 88.0/12.0.
Anion-modified PVA: Gohseran L-3266 manufactured by The Nippon Synthetic Chemical Industry Co., Ltd.
Unmodified PVA: Gohsenol GH-17 manufactured by The Nippon Synthetic Chemical Industry Co., Ltd.
Sodium alkyl benzene sulfonate: the number of carbon atoms in the alkyl group is 12 to 16.
Sodium alkyl ether sulfate: Sodium polyoxyethylene (number of ethylene oxide units added on average: 2.0) alkyl (C12 to C16) ether sulfate
Polyoxyethylene alkyl ether: the number of ethylene oxide units added on average is 10, and the number of carbon atoms in the alkyl group is 12 to 16.
Alkyl glycoside: Alkyl (C10 to C16) polyglucose (average sugar condensation degree: 1 to 2)
Alkyl amide propyl betaine: Fatty acid (C12) amide propyl-N,N-dimethyl-acetic betaine
Alkyl dimethyl benzyl ammonium chloride: the number of carbon atoms in the alkyl group is 12 to 16.
Chelating agent: Mixture of EDTA/citric acid = 4.3 (mixing ratio)

The invention claimed is:

1. A method of treating hard surfaces, which comprises applying a detergent onto the hard surfaces;

wherein the detergent comprises (a) a polymer compound comprising structural units (a1), (a2) and (a3) represented by the following general formulae (1), (2) and (3) respectively, (b) a surfactant, and (c) water:

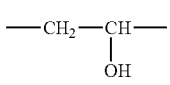

(1)

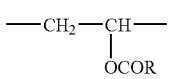

(2)

(3)

wherein R is a C1 to C3 alkyl group, and X is a structural unit derived from an unsaturated compound having a cation group in the molecule thereof and being copolymerizable with a vinyl alcohol lower fatty acid ester.

2. The method of treating hard surfaces according to claim 1, wherein a total amount of the structural units (a1), (a2) and (a3) in the structural units of (a) is 50 to 100 mol %.

3. The method of treating hard surfaces according to claim 1 or 2, wherein the total of the structural unit (a3) in the structural units of (a) is 0.001 to 10 mol %.

4. The method of treating hard surfaces according to claim 1, wherein the ratio of the structural unit (a1) to the structural unit (a2) in (a), that is, (a1)/(a2), is in the range of 1000 to 1.

5. The method of treating hard surfaces according to claim 1, wherein the structural unit (a3) of the structural units in (a) is derived from a compound selected from compounds represented by the following general formulae (3-1) and (3-2), respectively:

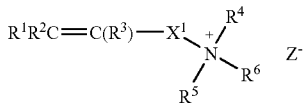

(3-1)

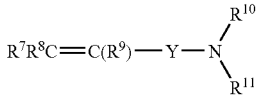

(3-2)

wherein $R^1$, $R^2$, $R^3$, $R^7$, $R^8$, and $R^9$ independently represent a hydrogen atom or a C1 to C3 alkyl group; $X^1$ and Y independently represent a group selected from a $C_1$ to $C_{12}$ alkylene group, —$COOR^{12}$—, —$CONHR^{12}$—, —$OCOR^{12}$ and —$R^{13}OCO$—$R^{12}$— wherein $R^{12}$ and $R^{13}$ independently represent a C1 to C5 alkylene group; $R^4$ represents a C1 to C3 alkyl group, a hydroxyalkyl group or $R^1R^2C{=}C(R^3){-}X^1{-}$; $R^5$ represents a C1 to C3 alkyl group or a hydroxyalkyl group; $R^6$ represents a C1 to C3 alkyl group, a hydroxyalkyl group or a benzyl group; Z represents an anion; $R^{10}$ represents a hydrogen atom, a C1 to C3 alkyl group, a C1 to C3 hydroxyalkyl group or $R^7R^8C{=}C(R^9){-}Y{-}$; and $R^{11}$ represents a hydrogen atom, a C1 to C3 alkyl group or a C1 to C3 hydroxyalkyl group.

6. The method of treating hard surfaces according to claim 1, which comprises 0.001 to 5% by weight of (a) and 0.001 to 20% by weight of (b).

7. The method of treating hard surfaces according to claim 1, wherein said method provides an accelerated drying effect to said hard surfaces.

8. The method of treating hard surfaces according to claim 1, wherein said method provides an antimolding treatment to said hard surfaces.

9. The method of treating hard surfaces according to claim 1, wherein said method provides an antifouling treatment to said hard surfaces.

10. The method of treating hard surfaces according to claim 1, wherein said method allows water to drain off said hard surfaces without leaving water droplets after being treated.

11. The method of treating hard surfaces according to claim 1, wherein said method further comprises cleaning the hard surfaces with the detergent.

* * * * *